US007357238B2

(12) United States Patent
Zeigler

(10) Patent No.: US 7,357,238 B2
(45) Date of Patent: Apr. 15, 2008

(54) EXPANDABLE AND COLLAPSIBLE MODULAR STRUCTURE

(75) Inventor: Theodore R. Zeigler, Alexandria, VA (US)

(73) Assignee: World Shelters, Inc., Alexandria, VA (US)

( * ) Notice: Subject to any disclaimer, the term of this patent is extended or adjusted under 35 U.S.C. 154(b) by 695 days.

(21) Appl. No.: 10/709,786

(22) Filed: May 27, 2004

(65) Prior Publication Data

US 2005/0262779 A1 Dec. 1, 2005

(51) Int. Cl.
*E04H 12/18* (2006.01)
*B65G 13/00* (2006.01)

(52) U.S. Cl. ..... 193/35 TE; 52/645; 52/646; 52/648.1

(58) Field of Classification Search ..... 198/35 TE, 198/35 MD; 52/645, 646, 648.1
See application file for complete search history.

(56) References Cited

U.S. PATENT DOCUMENTS 3,190,405 A * 6/1965 Squire ..... 52/637
3,496,687 A * 2/1970 Greenberg et al. ..... 52/109
3,968,808 A 7/1976 Zeigler
4,026,313 A 5/1977 Zeigler
4,036,466 A * 7/1977 Van Meter ..... 249/18
4,276,726 A * 7/1981 Derus ..... 52/109
4,280,521 A 7/1981 Zeigler
4,290,244 A 9/1981 Zeigler
4,334,660 A 6/1982 Zeigler
4,359,305 A 11/1982 Young et al.
4,437,275 A 3/1984 Zeigler
4,473,986 A 10/1984 Zeigler
4,512,097 A 4/1985 Zeigler
4,518,061 A 5/1985 Wehmeyer et al.
4,522,008 A 6/1985 Zeigler
4,561,618 A 12/1985 Zeigler
4,579,066 A 4/1986 Zeigler
4,625,830 A 12/1986 Wehmeyer et al.
4,637,180 A 1/1987 Zeigler
4,658,560 A * 4/1987 Beaulieu ..... 52/646
4,666,102 A 5/1987 Zeigler et al.
4,689,932 A 9/1987 Zeigler
4,747,239 A 5/1988 Zeigler
4,761,929 A 8/1988 Zeigler
4,800,663 A 1/1989 Zeigler
4,838,003 A 6/1989 Zeigler
4,970,841 A 11/1990 Zeigler
RE33,710 E 10/1991 Zeigler
5,230,196 A 7/1993 Zeigler
5,274,980 A 1/1994 Zeigler
5,327,700 A * 7/1994 Sorenson et al. ..... 52/109
5,367,852 A * 11/1994 Masuda et al. ..... 52/651.06
5,444,946 A 8/1995 Zeigler
5,456,347 A 10/1995 Best et al.
5,456,348 A 10/1995 Whetsel et al.

(Continued)

*Primary Examiner*—Douglas A Hess
(74) *Attorney, Agent, or Firm*—WRB-IP LLP

(57) ABSTRACT

An expandable and collapsible structural module is provided. The module includes at least three strut pairs, the at least three strut pairs being arranged end to end, at least three corners being defined by connected ends of the at least three strut pairs. The module also includes at least three legs pivotably connected at respective ones of the at least three corners to the connected ends of the at least three strut pairs, at least one of the at least three legs being a telescoping leg.

30 Claims, 9 Drawing Sheets

U.S. PATENT DOCUMENTS

| | | | | |
|---|---|---|---|---|
| 5,632,371 | A | 5/1997 | Best et al. | |
| 5,651,228 | A | 7/1997 | Zeigler | |
| 5,701,713 | A * | 12/1997 | Silver | 52/645 |
| 6,141,934 | A | 11/2000 | Zeigler | |
| 6,550,491 | B1 * | 4/2003 | Bixler et al. | 135/145 |
| 6,585,083 | B2 * | 7/2003 | Santarlasci | 182/118 |
| 6,588,568 | B1 | 7/2003 | Flippo | |
| 6,598,614 | B2 * | 7/2003 | Liu | 135/131 |
| 6,729,460 | B2 | 5/2004 | Esser | |
| 6,799,594 | B2 * | 10/2004 | Kuo | 135/147 |
| 7,188,842 | B2 | 3/2007 | Thorpe | |
| 7,296,699 | B2 | 11/2007 | Hung et al. | |

* cited by examiner

EXPANDABLE AND COLLAPSIBLE MODULAR STRUCTURE

The present invention relates to expandable and collapsible structures and, more particularly, to expandable and collapsible structures constructed from modular units.

My prior U.S. Pat. Nos. 6,141,934, 5,651,228, 5,444,946, 5,274,980, 5,230,196, RE33,710, 4,970,841, 4,838,003, 4,800,663, 4,761,929, 4,747,239, 4,689,932, 4,666,102, 4,637,180, 4,579,066, 4,561,618, 4,522,008, 4,512,097, 4,473,986, 4,437,275, 4,334,660, 4,290,244, 4,280,521, 4,026,313, and 3,968,808 are incorporated by reference and show various collapsible structures and components therefor. These structures are generally intended for use as shelters and are typically designed to support loads comprising covers and other miscellaneous items, and are also typically designed for flexibility to accommodate outside forces such as wind.

It is desirable to provide expandable and collapsible structures that can support substantial loads while also remaining substantially rigid under a variety of conditions. Such structures can be particularly useful in supporting or conveying heavy loads, such as for purposes of conveying a human on a body board through a series of decontamination stations.

In accordance with an aspect of the present invention, an expandable and collapsible structural module is provided. The module includes at least three strut pairs, each strut pair including a first strut having a first end and a second end and a second strut having a first end and a second end, the first strut and the second strut being pivotably connected to each other at a point between the first and second ends of the first strut and the second strut, respectively, the at least three strut pairs being arranged end to end such that the first end of a first strut of any strut pair of the at least three strut pairs is pivotably attached to the second end of a second strut of a preceding strut pair of the at least three strut pairs and the first end of any second strut of the at least three strut pairs is pivotably attached to the second end of a first strut of the preceding strut pair, at least three corners being defined by connected ends of the at least three strut pairs. The module also includes at least three legs pivotably connected at respective ones of the at least three corners to the connected ends of the at least three strut pairs, at least one of the at least three legs being a telescoping leg.

In accordance with another aspect of the invention, an expandable and collapsible structure includes a plurality of connected expandable and collapsible structural modules, each module comprising at least three strut pairs, each strut pair including a first strut having a first end and a second end and a second strut having a first end and a second end, the first strut and the second strut being pivotably connected to each other at a point between the first and second ends of the first strut and the second strut, the at least three strut pairs being arranged end to end such that the first end of a first strut of any strut pair of the at least three strut pairs is pivotably attached to the second end of a second strut of a preceding strut pair of the at least three strut pairs and the first end of any second strut of the at least three strut pairs is pivotably attached to the second end of a first strut of the preceding strut pair, at least three corners being defined by connected ends of the at least three strut pairs, and at least three legs pivotably connected at respective ones of the at least three corners to the connected ends of the at least three strut pairs, at least one of the at least three legs being a telescoping leg.

In accordance with another aspect of the present invention, an expandable and collapsible conveyor arrangement includes at least one expandable and collapsible structural module, each module comprising at least three strut pairs, each strut pair including a first strut having a first end and a second end and a second strut having a first end and a second end, the first strut and the second strut being pivotably connected to each other at a point between the first and second ends of the first strut and the second strut, the at least three strut pairs being arranged end to end such that the first end of a first strut of any strut pair of the at least three strut pairs is pivotably attached to the second end of a second strut of a preceding strut pair of the at least three strut pairs and the first end of any second strut of the at least three strut pairs is pivotably attached to the second end of a first strut of the preceding strut pair, at least three corners being defined by connected ends of the at least three strut pairs, and at least three legs pivotably connected at respective ones of the at least three corners to the connected ends of the at least three strut pairs, at least one of the at least three legs being a telescoping leg. The conveyor arrangement also includes at least one tension member disposed between ends of two or more legs.

In accordance with still another aspect of the present invention, a hub assembly for pivotably connecting four struts includes a central axis, and four connection points arranged in a plane around and perpendicular to the central axis for pivotably connecting four respective struts, each strut having a longitudinal axis, each connection point being disposed relative to the central axis so that the longitudinal axis each of the four struts to be connected is offset from the central axis.

BRIEF DESCRIPTION OF THE DRAWINGS

The features and advantages of the present invention are well understood by reading the following detailed description in conjunction with the drawings in which like numerals indicate similar elements and in which.

DISCLOSURE OF INVENTION

Figure 1A:
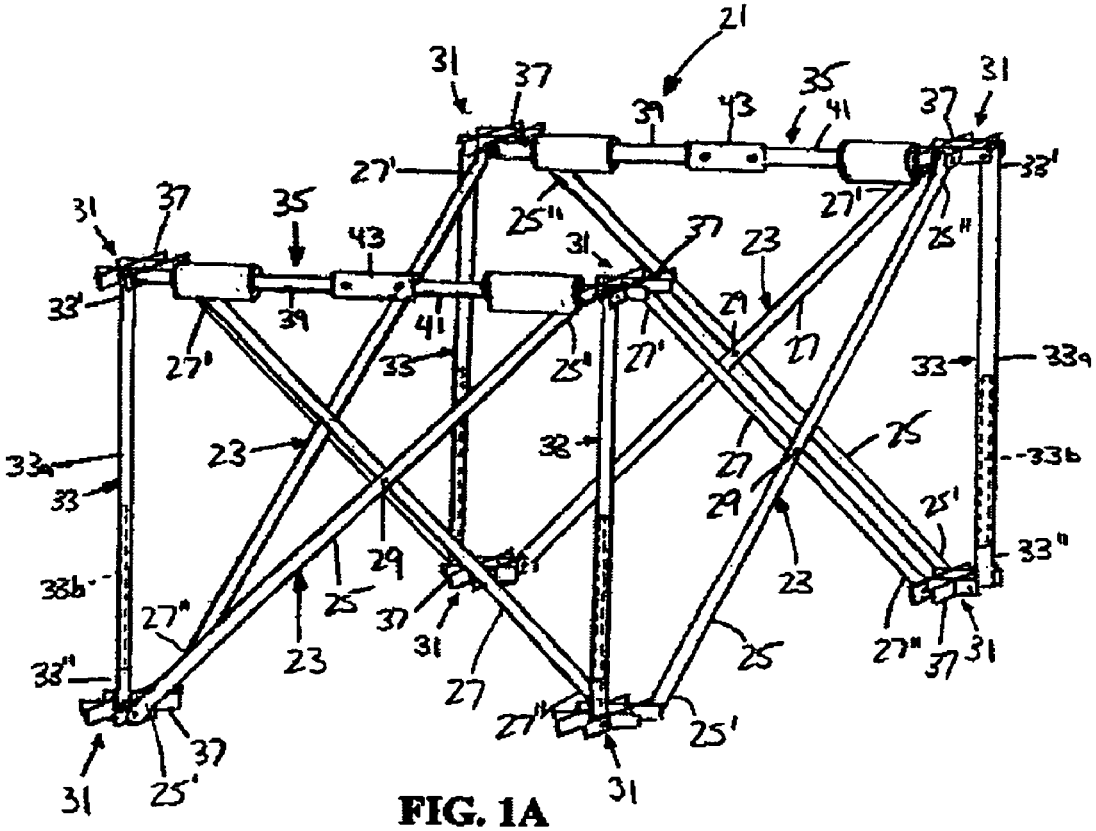
FIG. 1A is a perspective view of an expanded module according to an embodiment of the present invention.
Figure 1B:
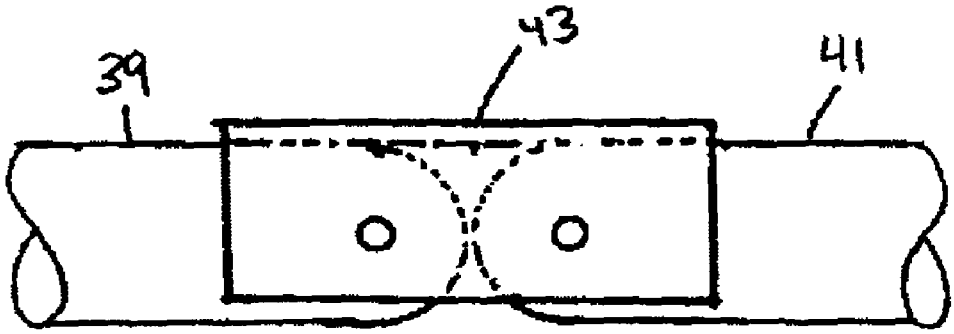
FIGS. 1B and 1C show a portion of a tension member of the module according to an embodiment of the invention in an unfolded and a folded condition, respectively.
Figure 1C:
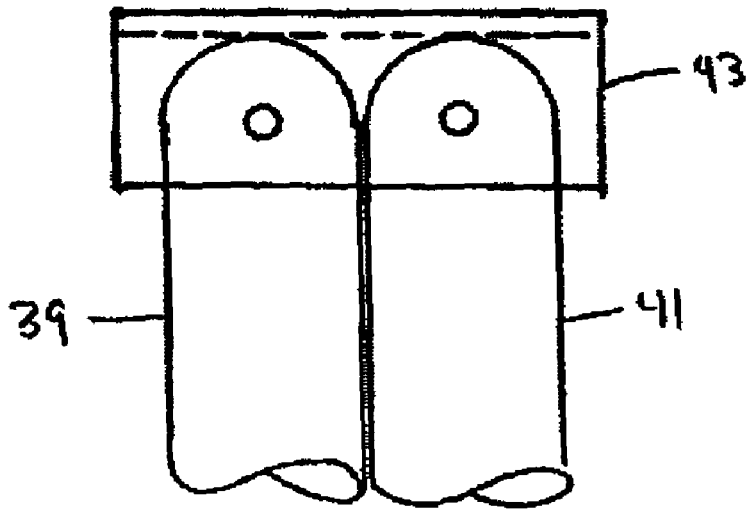

An expandable and collapsible structural module 21 according to an embodiment of the present invention is shown in FIG. 1A. The module 21 includes at least three strut pairs 23. In the embodiment shown in FIG. 1A, the module includes four strut pairs 23. The present invention will largely be described here in connection with embodiments of the module 21 having four strut pairs and wherein the structural module is movable between an expanded condition in which the structural module has a substantially cube shape and a folded condition shown in FIG. 2 in which the struts of the four strut pairs and any legs are substantially parallel. However, it will be understood that modules according to the present invention may have as few as three strut pairs and there is substantially no upper limit to the number of strut pairs that can be included in a module.

Each strut pair 23 includes a first strut 25 having a first end 25' and a second end 25" and a second strut 27 having a first end 27' and a second end 27". The first strut 25 and the second strut 27 are pivotably connected to each other, such as by a pin, at a point 29 between the first and second ends 25' and 25" and 27' and 27" of the first strut 25 and the second strut, respectively.

The strut pairs 23 of the module 21 are arranged end to end, i.e., in a triangle, a square, a pentagon, a hexagon, etc., such that the first end 25' of a first strut 25 of any strut pair of the strut pairs is pivotably attached to the second end 27" of a second strut 27 of a preceding strut pair of the strut pairs of the module, and the first end 27' of any second strut of the strut pairs is pivotably attached to the second end 25" of a first strut of the preceding strut pair. Corners 31 are defined by connected ends of the strut pairs 23 of a module 21. Each module also includes legs 33 pivotably connected at respective ones of the corners 31 to the connected ends of the strut pairs 23. The legs 33, when oriented vertically, have upper and lower ends 33' and 33", respectively. Though it will be appreciated that the legs 33 may be oriented horizontally or otherwise, for purposes of discussion here, the legs will be considered to be oriented vertically.

The structural module 21 may include one or more tension members 35 disposed between upper or lower ends 33' or 33", or both, of two or more of the legs 33. While the tension members 35 are ordinarily pivotably connected to hubs 37 to which the legs 33 and struts 25 and 27 are attached, the tension members may be pivotably connected elsewhere, such as by being pivotably connected to the struts. The tension members 35 may include structural members such as a cable, however, FIG. 1A shows tension members including a foldable strut member having first and second rigid, foldable strut portions 39 and 41 and a stop 43, seen in greater detail with the tension member in an unfolded and a folded condition in FIGS. 1B and 1C, for preventing the foldable strut member from passing a line L defined by ends of two legs between which the foldable strut is disposed. If desired, a single-piece rigid strut may be used and one or both ends of the strut may be attachable between and detachable from between the legs 33. The tension members 35 shown in FIGS. 1A-1C and 2 are shown as being adapted to fold upwardly, however, it will be appreciated that the tension members may fold in any desired direction by appropriately positioning the stop. For example, the tension members 35 may fold inwardly toward the center of the module 21 by positioning the stop on the opposite side of the tension member elements shown in FIG. 2.

The tension members 35 will ordinarily be of a length selected to prevent the structural module 21 from expanding beyond a predetermined expanded position. The legs 33 of the module 21 may be telescopic and the leg components may be sized such that, when the tension members 35 are fully extended, the legs are telescoped to their smallest position. A telescoping leg 33 may include at least a first portion 33*a* and a second portion 33*b*. A combined length of the first portion 33*a* and the second portion 33*b* may be greater than a length of any strut 25 or 27 of the strut pairs 23 so that, when the strut pairs are folded to a folded position, the first and second portions of the leg do not separate.

Figure 3:
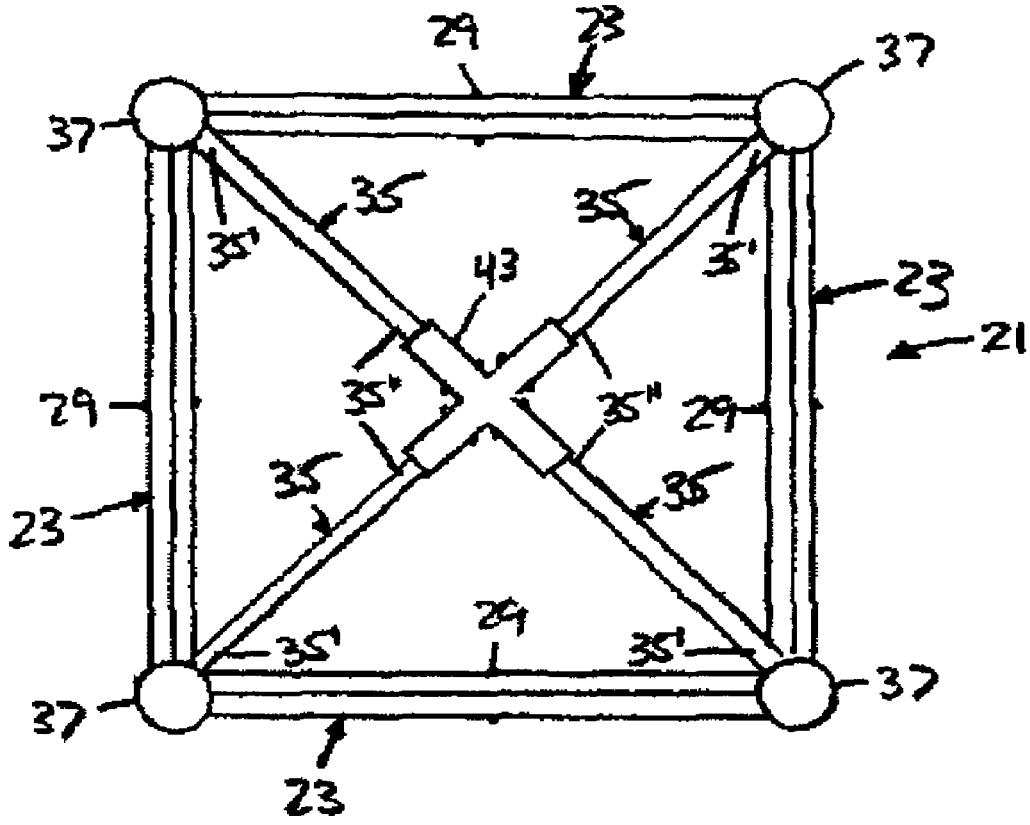
FIG. 3 is a perspective view of a module according to a further embodiment of the present invention.

The tension members 35 may be disposed between legs 33 disposed at opposite ends of a single strut pair 23, i.e., running around the periphery or part of the periphery of the module 21 and/or (as shown in phantom) between legs disposed at opposite ends of different strut pairs, e.g., running diagonally across a square module. As seen in FIG. 3, a module 21 may also have three or more connected tension members 35 that each have a first end 35' attached proximate a respective one of the legs 33, e.g., at a suitable hub 37, and a second end 35" attached to second ends 35" of the other ones of the connected tension members, e.g., directly or by means of a suitable stop 43. In this case, if the tension members 35 are rigid, if desired, a hub 37 may be used to pivotably attach the second ends 35" of the tension members.

Figure 4:
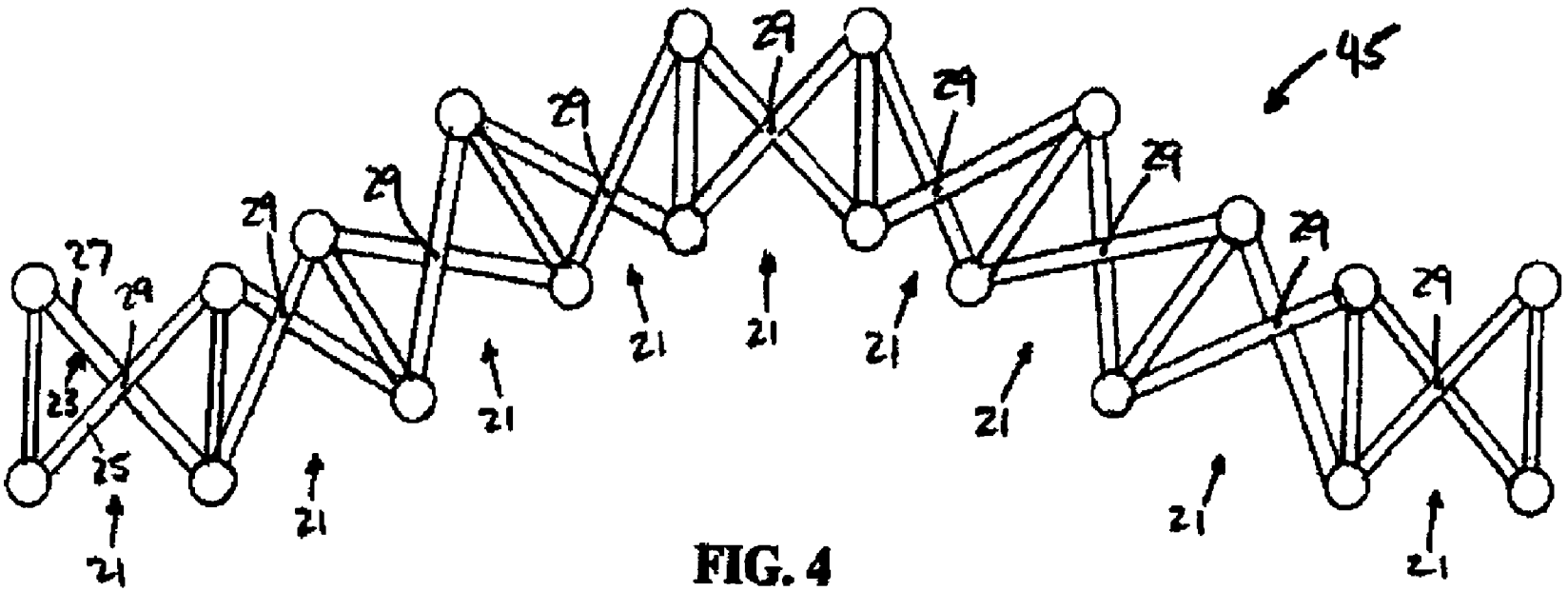
FIG. 4 is a side plan view of a structure formed from a series of connected modules according to an embodiment of the present invention.

As seen in FIG. 1A, the first and second struts 25 and 27 of each strut pair 23 of any module 21 may be pivotably connected to one another at connection points 29 at centerpoints of the first and second struts to form a square or rectangular shape. However, as seen in FIG. 4, if desired, the first and second struts 25 and 27 of some strut pairs 23 or each strut pair of the module 21 may be pivotably connected to one another at points 29 removed from centerpoints of the first and second struts. By connecting together a series of modules 21, at least some of which have strut pairs 23 with struts that are connected in such an offset manner, a variety of curving structures can be formed.

Figure 5:
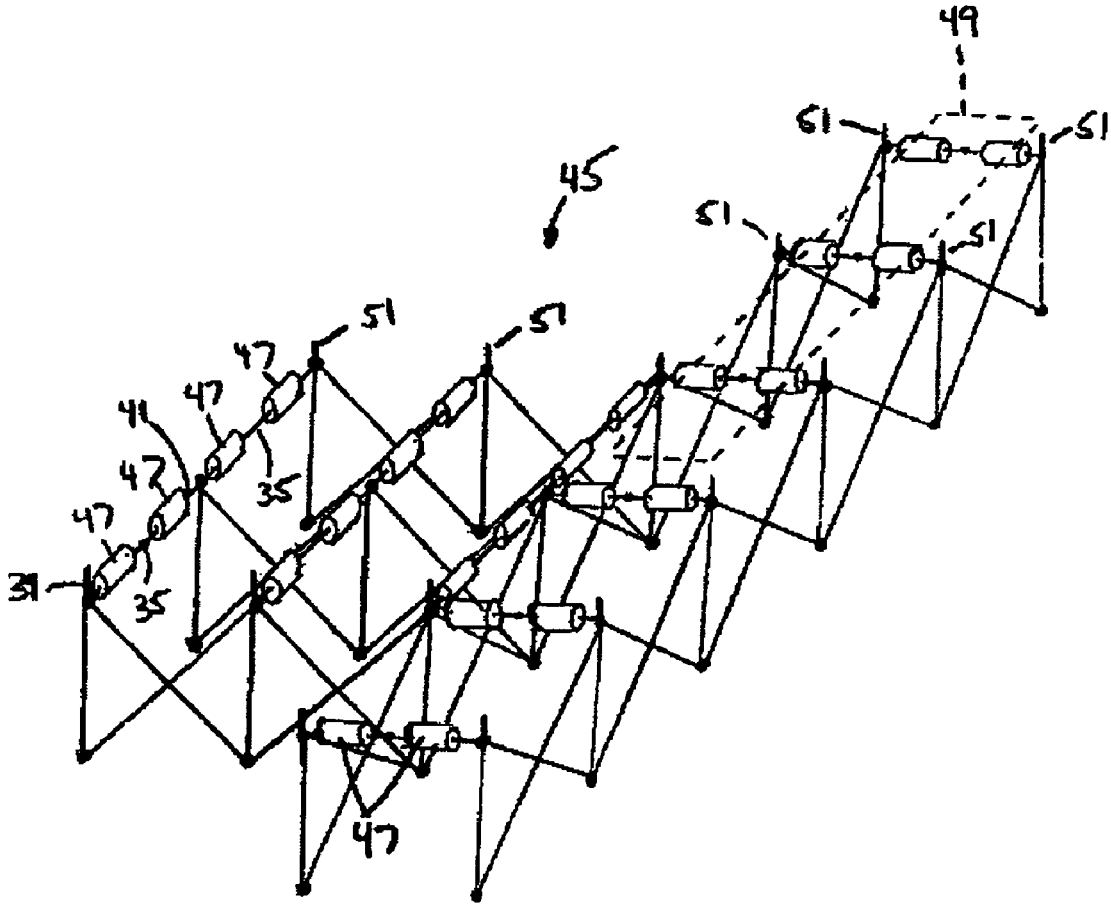
FIG. 5 is a perspective view of a structure formed from a series of connected modules according to an embodiment of the present invention.

As seen in FIGS. 4, 5, and 6, structures 45 of various shapes and sizes can be made from a plurality of connected modules 21. Connected modules 21 may be connected in a variety of ways and will ordinarily share one or more legs 33 or strut pairs 23. Ordinarily, connected modules 21 will be connected such that the two modules share two legs 33 and one strut pair 23. As seen in FIG. 5, a tension member 35 may be disposed between ends of legs 33 that are shared by two modules 21. In other words, two or more connected modules 21 may be connected to each other so that they extend in a first direction and a tension member 35 may be disposed between ends of shared legs 33 and extend in a second direction substantially perpendicular to the first direction. Tension members 35 can, of course, also extend around the periphery of the resulting structure 45, diagonally across one or more modules, etc.

FIG. 5 shows that at least certain tension members 35 can be provided with a roller arrangement 47. The roller arrangement 47 can take any suitable form, such as a single roller or plural rollers mounted on a single flexible or rigid tension member or, as seen in FIG. 5, on separate rigid portions 39 and 41 of a tension member.

The structure 45 shown in FIG. 5 has been found to be particularly useful as a conveyor, particularly in connection with use in mobile decontamination units. The structure 45 can be transported to a location in a folded condition, quickly unfolded to an expanded condition, and a body board 49 (shown in phantom) can be rolled over the tension members 35 to facilitate treatment of, for example, victims of chemicals or other substances, at various decontamination stations. If provided, the roller arrangements 47 facilitate movement of the body board. Protruding portions 51 can be provided to facilitate defining a path along which a conveyed article may be conveyed and/or for guiding of a conveyed article. The protruding portions 51 can be portions of a hub 37 or other suitable portion of the structure 45. The structure 45 can, of course, be used in numerous applications other than conveying, as well. It may, for example, be useful as a supporting structure for table or desk tops.

As also seen in FIG. 5, a structure 45 wherein a first group of two or more connected modules 21 are connected to each other so that they extend in a first direction and a second group of two or more connected modules are connected to each other so that they extend in the second direction, such as a direction substantially perpendicular, to the first direction can be formed. In such a structure 45, each of the groups may share portions of the other group, such as a leg 33, two legs and a strut pair 23, one or more modules 21, etc.

Figure 6A:
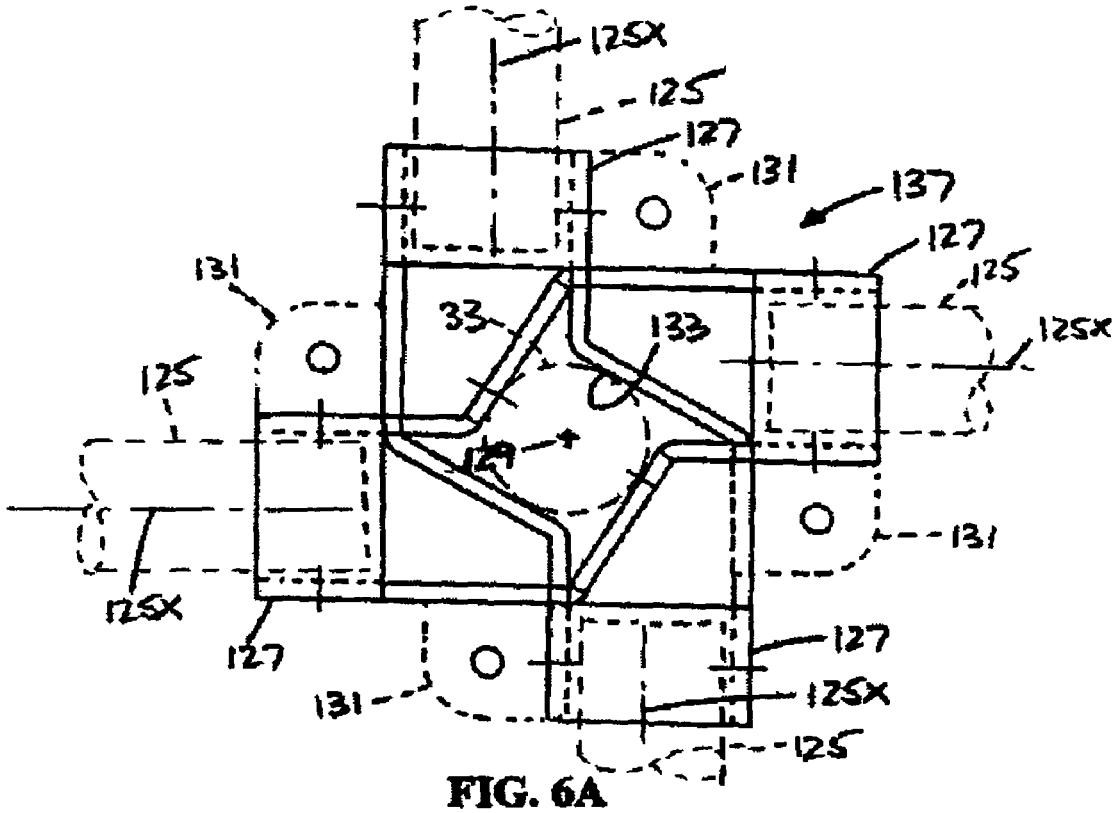
FIGS. 6A, 6B, 6C, and 6D are top plan, side plan, perspective, and exploded perspective views of a hub assembly according to an embodiment of the present invention.
Figure 6B:
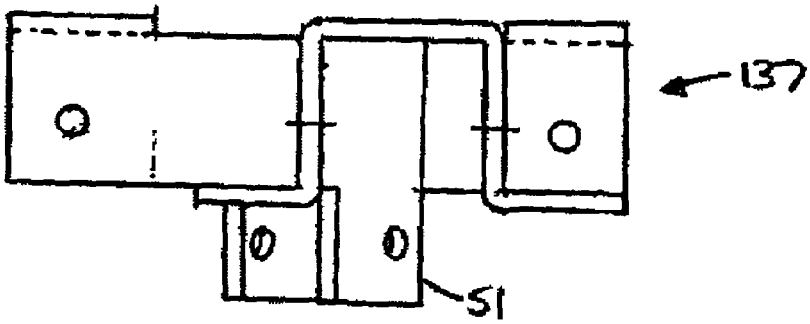

If a hub 37 is used, the hub may be any suitable form of hub, such as the hub disclosed in my U.S. Pat. No. 4,280,521. A hub assembly 137 that is considered to be particularly useful for a structure that uses relatively thick, rigid struts, legs, and tension members is shown in FIGS. 6A-6D. As seen in FIG. 6A, the illustrated hub assembly 137 facilitates pivotably connecting four struts 125 to four connection points 127 arranged in a plane around and perpendicular to a central axis 129. Each strut 125 has a longitudinal axis 125X and each connection point 127 is disposed relative to the central axis 129 so that the longitudinal axis each of the four struts to be connected is offset from the central axis. Connection points 131 for cables 131C or other members may also be provided. Each cable connection point 131—so called to distinguish them from the connection points 127—may be associated with a corresponding one of the four connection points 127.

An opening 133 can be provided that extends along the central axis 129 for attaching a leg strut 33. Protruding portions 51 can be provided to at least partially define the opening 133. The protruding portions 51 may extend parallel to the central axis 129. Protruding portions 51 can be provided to facilitate defining a path along which a conveyed article may be conveyed and/or for guiding of a conveyed article.

Figure 6C:
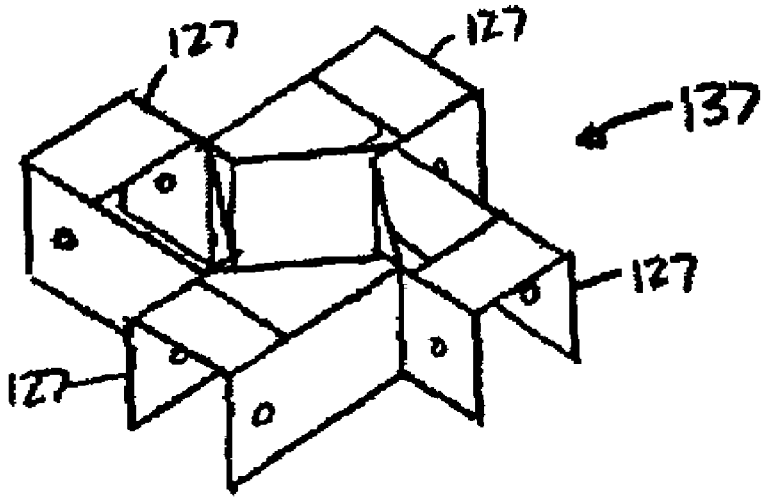
Figure 6D:
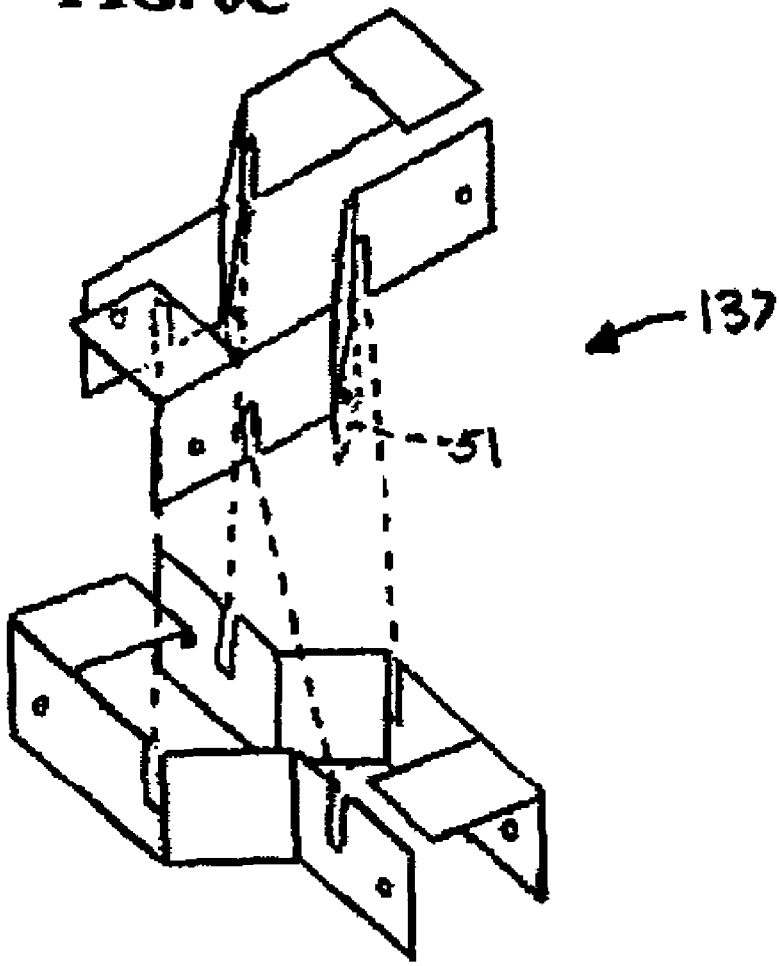

The hub assembly 137 can be assembled from several pieces of a bent or molded sheet material, preferably a light-weight yet rigid material such as aluminum, as seen in FIGS. 6C-6D. As seen in FIG. 6A, each connection point can be adapted to connect struts having the same lateral dimension, e.g., diameter, for circular struts. In such a hub assembly, each connection point can be offset by a distance equal to at least half of the lateral dimension of the struts to be pivotably connected to the connection point. In this way, pivotably connected struts tend to not interfere with one another as they extend from one corner of the module 21 to another. The connection points can also be arranged to facilitate connection of struts having different lateral dimensions, e.g., different diameters for circular struts. Again, each connection point may be offset by a distance equal to at least half of the lateral dimension of the struts to be pivotably connected to the connection point to minimize the tendency of the struts to interfere with one another.

Figure 2:
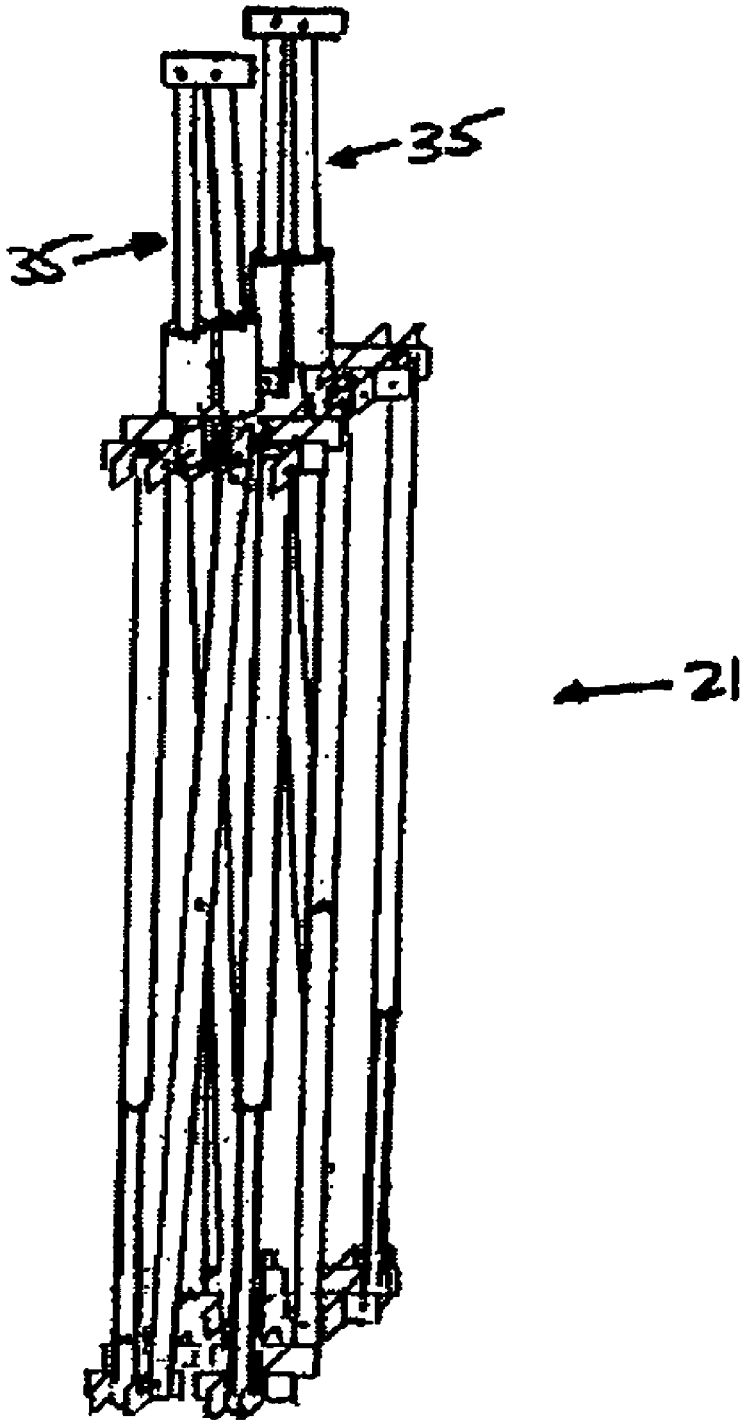
FIG. 2 is a perspective view of the module of FIG. 1A in a collapsed or folded condition.
Figure 7A:
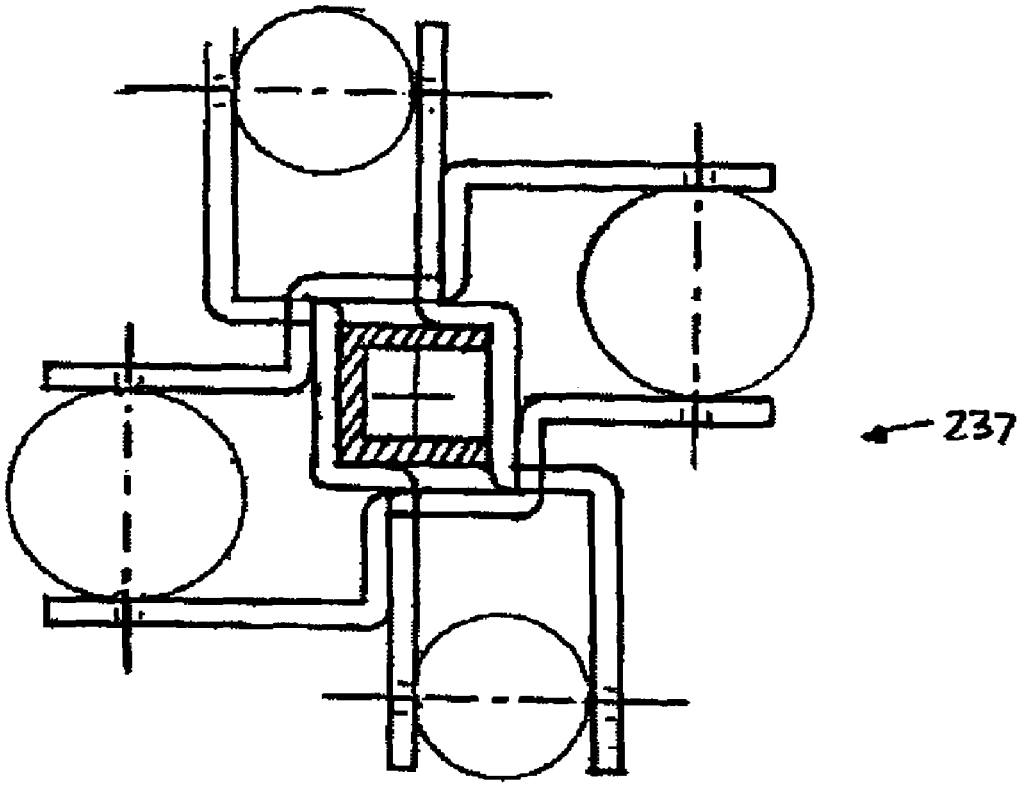
FIGS. 7A and 7B are top plan and side plan views of a hub assembly according to another embodiment of the present invention.
Figure 7B:
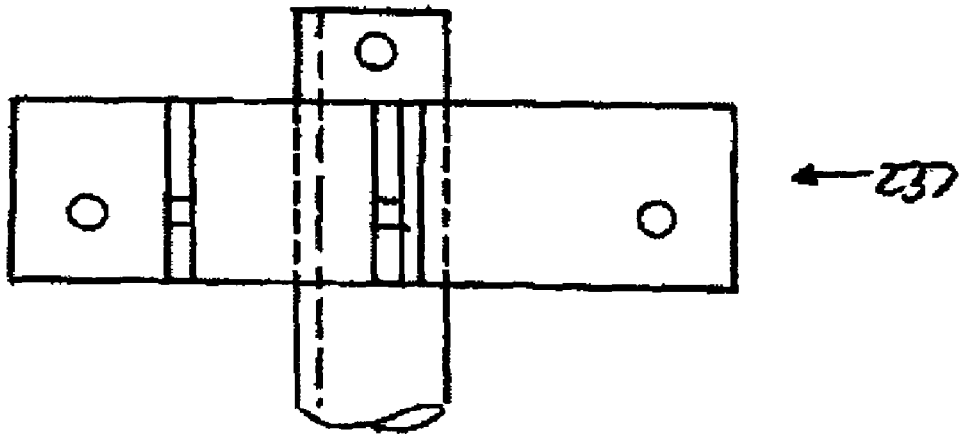

The shape of the hub assembly shown in FIGS. 6A-6D is, of course, illustrative. Other shapes formed from other components can also be made. Another embodiment of a hub assembly 237 using more squared sheet metal components and adapted to connect struts of different diameters is shown in FIGS. 7A-7B. FIGS. 1A and 2 show hub assemblies in the form of a grid formed by four criss-crossed members. Additionally, instead of the sheet material components shown, the hub assembly can be formed as a molded or machined member made from metal, plastic, or any other suitably strong material. Also, the hub assembly is not limited to accommodating four or fewer struts and can be designed to accommodate any number of struts by providing appropriate offsets of the connection points.

While this invention has been illustrated and described in accordance with a preferred embodiment, it is recognized that variations and changes may be made therein without departing from the invention as set forth in the claims.

The invention claimed is:

1. An expandable and collapsible structural module, comprising:

at least three strut pairs, each strut pair including a first strut having a first end and a second end and a second strut having a first end and a second end, the first strut and the second strut being pivotably connected to each other at a point between the first and second ends of the first strut and the second strut, respectively, the at least three strut pairs being arranged end to end such that the first end of a first strut of any strut pair of the at least three strut pairs is pivotably attached to the second end of a second strut of a preceding strut pair of the at least three strut pairs and the first end of any second strut of the at least three strut pairs is pivotably attached to the second end of a first strut of the preceding strut pair, at least three corners being defined by connected ends of the at least three strut pairs;

at least three legs pivotably connected at respective ones of the at least three corners to the connected ends of the at least three strut pairs, at least one of the at least three legs being a telescoping leg; and at least one tension member disposed between ends of two or more of the at least three legs, wherein the at least one tension member includes a foldable strut member.

2. The structural module as set forth in claim 1, wherein the at least three legs are vertical legs and at least one tension member is disposed between upper ends of two or more of the at least three legs.

3. The structural module as set forth in claim 1, wherein the at least three legs are vertical legs and at least one tension member is disposed between lower ends of two or more of the at least three legs.

4. The structural module as set forth in claim 1, wherein the at least one tension member includes a cable.

5. The structural module as set forth in claim 1, wherein the foldable strut member includes a stop for preventing the foldable strut member from passing a line defined by ends of two legs between which the foldable strut is disposed.

6. The structural module as set forth in claim 1, wherein the at least one tension member prevents the structural module from expanding beyond a predetermined expanded position.

7. The structural module as set forth in claim 1, wherein at least one of the at least one tension member includes at least one roller mounted thereon.

8. The structural module as set forth in claim 1, wherein at least one of the at least one tension member is disposed between legs disposed at opposite ends of a single strut pair.

9. The structural module as set forth in claim 1, wherein at least one of the at least one tension member is disposed between legs disposed at opposite ends of different strut pairs.

10. The structural module as set forth in claim 1, further comprising hubs for pivotably attaching ends of the struts of the at least three strut pairs, ends of the at least three legs, and ends of the at least one tension member.

11. The structural module as set forth in claim 1, further comprising hubs for pivotably attaching ends of the struts of the at least three strut pairs and ends of the at least three legs.

12. The structural module as set forth in claim 1, wherein all of the at least three legs are telescoping legs.

13. The structural module as set forth in claim 1, wherein each of the at least one telescoping leg includes a first portion and a second portion, a combined length of the first portion and the second portion being greater than a length of any strut of the at least three strut pairs.

14. The structural module as set forth in claim 1, comprising four strut pairs and four legs, the structural module being movable between an expanded condition in which the structural module has a substantially cube shape and a folded condition in which the struts of the four strut pairs and the four legs are substantially parallel.

15. The structural module as set forth in claim 1, comprising three or more connected tension members, the three or more tension members each having a first end attached proximate a respective one of the at least three legs and a second end attached to second ends of the other ones of the three or more connected tension members.

16. The structural module as set forth in claim 1, wherein the first and second struts of each strut pair of the at least three strut pairs are pivotably connected to one another at centerpoints of the first and second struts.

17. The structural module as set forth in claim 1, wherein the first and second struts of each strut pair of the at least three strut pairs are pivotably connected to one another at points removed from centerpoints of the first and second struts.

18. An expandable and collapsible structure, comprising:

a plurality of connected expandable and collapsible structural modules, each module comprising at least three strut pairs, each strut pair including a first strut having a first end and a second end and a second strut having a first end and a second end, the first strut and the second strut being pivotably connected to each other at a point between the first and second ends of the first strut and the second strut, the at least three strut pairs being arranged end to end such that the first end of a first strut of any strut pair of the at least three strut pairs is pivotably attached to the second end of a second strut of a preceding strut pair of the at least three strut pairs and the first end of any second strut of the at least three strut pairs is pivotably attached to the second end of a first strut of the preceding strut pair, at least three corners being defined by connected ends of the at least three strut pairs, and at least three legs pivotably connected at respective ones of the at least three corners to the connected ends of the at least three strut pairs, at least one of the at least three legs being a telescoping leg; and at least one tension member disposed between ends of two or more of the at least three legs, wherein the at least one tension member includes a foldable strut member.

19. The structure as set forth in claim 18, wherein at least two of the plurality of connected modules are connected such that the two modules share two legs and one strut pair.

20. The structure as set forth in claim 18, further comprising at least one tension member disposed between ends of two or more legs.

21. The structure as set forth in claim 20, wherein two or more connected modules are connected to each other so that they extend in a first direction and at least one tension member is disposed between ends of two or more legs and extends in a second direction substantially perpendicular to the first direction.

22. The structure as set forth in claim 21, wherein at least one of the at least one tension member includes at least one roller mounted thereon.

23. The structure as set forth in claim 18, wherein, for at least one module of the plurality of connected modules, the first and second struts of each strut pair of the at least three strut pairs are pivotably connected to one another at centerpoints of the first and second struts.

24. The structural module as set forth in claim 18, wherein, for at least one module of the plurality of connected modules, the first and second struts of each strut pair of the at least three strut pairs are pivotably connected to one another at points removed from centerpoints of the first and second struts.

25. An expandable and collapsible conveyor arrangement, comprising:

at least one expandable and collapsible structural module, each module comprising at least three strut pairs, each strut pair including a first strut having a first end and a second end and a second strut having a first end and a second end, the first strut and the second strut being pivotably connected to each other at a point between the first and second ends of the first strut and the second strut, the at least three strut pairs being arranged end to end such that the first end of a first strut of any strut pair of the at least three strut pairs is pivotably attached to the second end of a second strut of a preceding strut pair of the at least three strut pairs and the first end of any second strut of the at least three strut pairs is pivotably attached to the second end of a first strut of the preceding strut pair, at least three corners being defined by connected ends of the at least three strut pairs, and at least three legs pivotably connected at respective ones of the at least three corners to the connected ends of the at least three strut pairs, at least one of the at least three legs being a telescoping leg; and at least one tension member disposed between ends of two or more legs, wherein the at least one tension member includes a foldable strut member.

26. The conveyor arrangement as set forth in claim 25, wherein two or more connected modules are connected to each other so that they extend in a first direction and at least one tension member is disposed between ends of two or more legs and extends in a second direction substantially perpendicular to the first direction.

27. The conveyor arrangement as set forth in claim 26, wherein a second group of two or more connected modules are connected to each other so that they extend in the second direction and at least one tension member is disposed between ends of two or more legs of the second group and extends in the first direction substantially perpendicular to the first direction.

28. The structure as set forth in claim 25, further comprising a plurality of protruding members for defining a path along which a conveyed article may be conveyed.

29. The structure as set forth in claim 28, wherein the protruding members include hubs for pivotably attaching ends of the struts of the at least three strut pairs, ends of the at least three legs, and ends of the at least one tension member.

30. The structure as set forth in claim 25, wherein at least one of the at least one tension member includes at least one roller mounted thereon.

* * * * *